United States Patent [19]

Jacobsson

[11] 4,153,213

[45] May 8, 1979

[54] THREAD-DELIVERY DEVICE FOR TEXTILE MACHINES

[75] Inventor: Kurt A. G. Jacobsson, Ulricehamn, Sweden

[73] Assignee: Aktiebolaget IRO, Ulricehamn, Sweden

[21] Appl. No.: 883,930

[22] Filed: Mar. 6, 1978

[30] Foreign Application Priority Data

Mar. 11, 1977 [DE] Fed. Rep. of Germany ..... 2710821

[51] Int. Cl.[2] ..... B65H 51/20

[52] U.S. Cl. ..... 242/47.01

[58] Field of Search ..... 242/47.01–47.13; 66/132 R; 139/452

[56] References Cited

U.S. PATENT DOCUMENTS

| | | | |
|---|---|---|---|
| 3,625,444 | 12/1971 | Hatay | 242/47.01 |
| 3,820,731 | 6/1974 | Rosen | 242/47.01 |
| 3,928,987 | 12/1975 | Jacobsson | 242/47.01 X |
| 4,056,239 | 11/1977 | Fecker et al. | 242/47.01 |

*Primary Examiner*—Stanley N. Gilreath

*Attorney, Agent, or Firm*—Blanchard, Flynn, Thiel, Boutell & Tanis

[57] ABSTRACT

A thread-delivery device for textile machines, comprising a drum which can be driven for rotation, onto which drum can be tangentially wound a thread coming from a thread bobbin for forming an intermediate thread storage, and from which for positive delivery the thread can be removed tangentially in the area of a removal edge of the drum through a thread-guiding member which is arranged approximately at the level of the removal edge radially outside of the drum. A thread-control element is provided which is transversely movably supported relative to the withdrawn thread, which thread-control element is maintained by the withdrawn thread in one operating position in the area of the thread path between the drum and the thread-guiding member approximately at the level of the removal edge of the drum when the withdrawn thread is at normal operating tension. The thread-control element moves when the thread tension is reduced due to its weight or spring loading into a position below the plane of the removal edge. The thread-guiding member is displaceable from a first position at the level of the removal edge to a second position below the level of the removal edge, or an additional thread-guiding member is provided at the second position below the level of the removal edge. The thread-control element is lockable in a position spaced from the thread path when the thread-guiding member is in its second position, or when the thread travels through the additional thread-guiding member.

15 Claims, 6 Drawing Figures

THREAD-DELIVERY DEVICE FOR TEXTILE MACHINES

FIELD OF THE INVENTION

The invention relates to a thread-delivery device for textile machines, comprising a drum which can be driven for rotation, onto which drum a thread which comes from a thread bobbin can be wound tangentially for forming an intermediate storage, and from which for positive delivery the thread can be removed tangentially in the area of a removal edge of the drum through a thread-guiding member which is arranged approximately at the level of the removal edge radially outwardly of the drum. A thread-control element, which is transversely movably supported relative to the withdrawn thread, is provided for engaging the withdrawn thread in the area of the thread path between the drum and the thread-guiding member, whereby the operating tension of the withdrawn thread maintains the thread-control element approximately at the level of the drum removal edge. The thread-control element moves, when the thread tension is reduced, due to its weight or spring loading into a position below the plane of the removal edge.

BACKGROUND OF THE INVENTION

A thread-delivery device of the above type, as disclosed in copending application Ser. No. 793 254, filed May 3, 1977, now U.S. Pat. No. 4,106,713 has the thread-guiding member stationarily arranged approximately at the level of the plane of the removal edge and constructed as a closed eyelet. The thread-control element is in the form of a closed eyelet mounted on a bent swivel arm. This construction is designed for thread material in which adjacent windings have the tendency to adhere relatively strongly to one another, either due to fleeceness of the thread or due to electrostatic charge effects. For such threads it is important that the removal from the drum takes place under normal thread tension as much as possible exactly tangentially, because a force or tension component which is applied under the plane of the removal edge can cause the winding which follow the removed winding to also be pulled downwardly. Since this would lead to a considerable error in the textile product, it is accepted that the movable thread-control element applies a light additional tension on the thread section between the drum and the stationary thread-guiding member. If with the same machine a thread is processed in which no such adhesive effect exists between adjacent windings, it would be possible, as is known from German Offenlegungsschrift No. 2 312 267, to remove the thread from the drum in a downwardly inclined direction while still providing for positive thread delivery. In this case the movable thread-control element, which is provided to cause the removal direction to be deflected downwardly when the thread becomes loose, in order that the thread is not rewound onto the drum in the wrong direction, would not be needed.

The purpose of this invention is to further develop a thread-delivery device according to the above-mentioned application in such a manner that it can be adjusted or switched over quickly and in a simple manner to the type of removal which is most favorable for the respective thread material, whereby in every case it is assured that an undesired rewinding of loose thread back onto the drum is avoided.

This purpose is attained, in one embodiment of the invention, by adjustably moving the thread-guiding member from a first position at the level of the removal edge into a second position below the removal edge, and by the thread-control element being fixable relative to the thread-guiding member, at a position outside of the thread path, when the thread-guiding member is adjusted downwardly into the second position.

Thread with great adhesive effect is removed from the drum through the thread-control element and the thread-guiding member when the latter is arranged in its first position at the level of the removal edge. For thread without any significant adhesive effect, the thread-guiding member is adjusted into its second position below the plane of the removal edge, and the thread-control element which is not needed during this operation is removed from the thread path. The adjusting or moving of the thread-guiding member and thread-control element is made possible by very simple structural measures and can be carried out with two simple manipulations. With a small work effort, the device can achieve optimum use with different types of threads.

The thread-control element can be advantageously and simply fixed in a first position above the thread path. In this position, it visually indicates to the operator that it is not in engagement with the withdrawn thread. If the thread-control element becomes loose, it automatically moves into engagement with the thread and the condition is also visually indicated to the operator.

When adjusting operations are carried out on the machine, the thread-control element can be fixed in a second position below the plane of the removal edge. This position makes possible an intermittent thread delivery.

In a preferred embodiment, the thread-control element is constructed as a downwardly open angle hook on a swivel arm. Thus, the thread is not threaded through a closed eyelet. The thread-control element can thus at any time be moved from one fixed position into the other fixed position, or moved into the thread path, and vice versa, even when the thread has already been guided from the drum to the textile machine. In its movable control position, the angled shape of the thread-control element prevents with certainty any loss of engagement between the control element and the thread. Manufacture is particularly simple because the thread-control element can be formed with its swivel arm in one piece, as by bending.

In a simple and optically understandable manner, it is possible for the operator to fix the thread-control element in its first position by means of a projecting snap-in mounting positioned above the thread-guiding member, which mounting defines an angular shoulder corresponding with the configuration of the angle hook. A snap-in mounting in the area of the swivel arm is also possible. Since fixing in the second position, in which the thread-control element is below the drum, is possible only in the area of the swivel arm, such an arrangement is less noticeable, although this may lead to an incorrect fixation due to carelessness.

In an advantageous further development, the thread-guiding member is constructed as an upwardly opening V-shaped hook and is arranged with its two legs in a plane approximately transversely to the thread. In this manner, threading therethrough of the thread is simplified without the secure guiding of the thread being endangered.

Further details of the invention can be taken from the drawings and the associated description.

DETAILED DESCRIPTION

Figure 1:
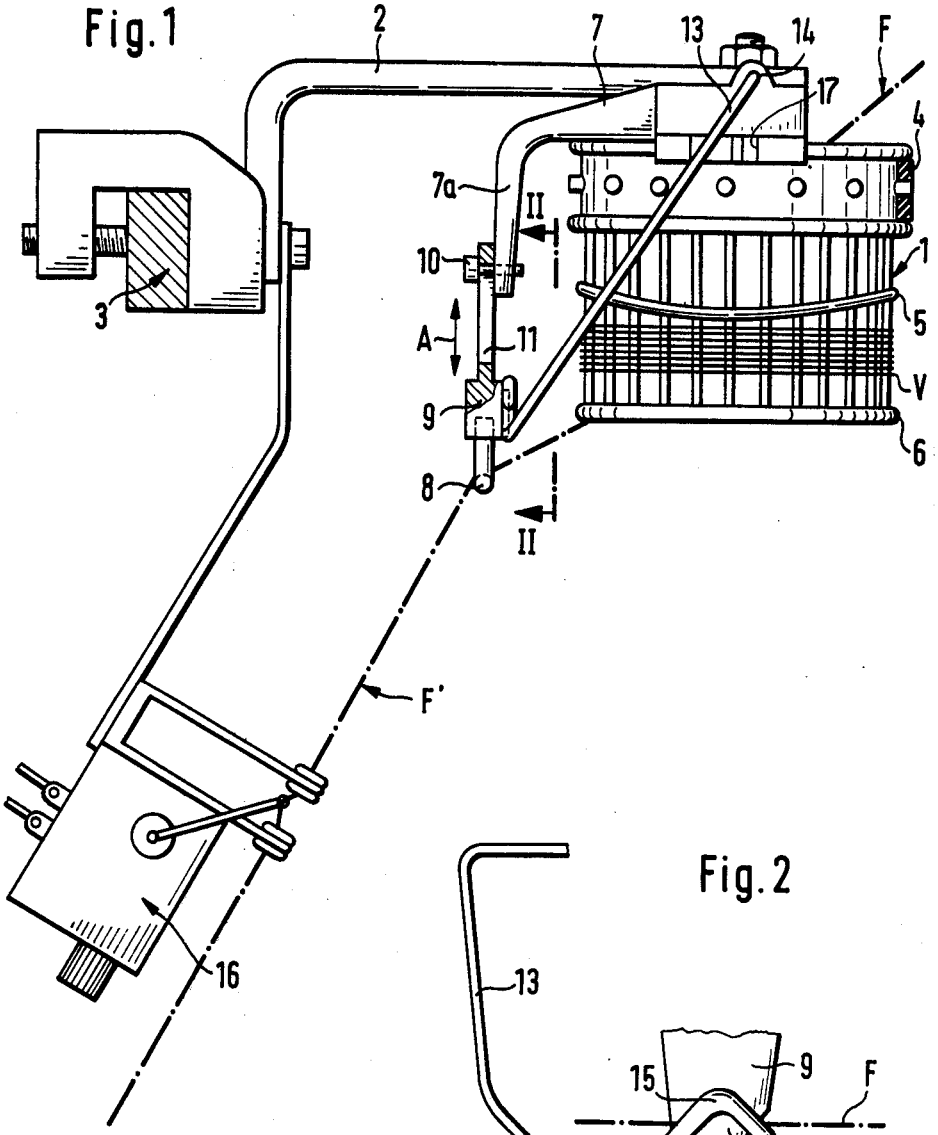
FIG. 1 illustrates an inventive thread-storage and delivery device in one operating position.

A drum which is identified as a whole with reference numeral 1 is held on a knitting machine which is indicated only by a support ring 3 by means of a carrying device 2. The drum can be rotatably driven by a driving belt 4 which is driven by the drive of the knitting machine. A thread-displacing disk 5 is supported on the drum to transport the intermediate thread storage V in a direction toward the removal edge 6 of the drum. The intermediate thread storage V consists of several thread windings. The intermediate thread storage is formed by a thread F which is fed from a thread bobbin (not shown) through an inlet thread guide and brake (not shown) onto the drum, and leaves the drum as an unwinding thread F'.

A bent supporting arm 7 is arranged on the carrying device 2 in such a manner that its leg *7a* extends spaced from the drum approximately parallel to its axis. The supporting arm leg *7a* carries a thread-guiding member 8. Same is constructed as a V-shaped hook and is secured on a holding plate 9. The holding plate 9 in turn can be adjusted elevationally on the supporting arm leg *7a* by means of a locking screw 10 which extends through a slot 11 in the holding plate and can be screwed into the leg *7a*. The V-shaped thread-guiding member 8 opens upwardly, namely in the direction in which the drum extends from the plane of its removal edge 6. The term "below" hereinafter means the area or direction which extends away from the drum starting from the plane of the removal edge 6. The thread-guiding member 8 is, in the operating position, aligned such that a plane which passes through its two legs extends approximately parallel to the main direction of extent of the leg *7a*.

The holding plate 9, on the side thereof which faces the drum, is formed with a projection 12 which defines thereabove the angular lock shoulder.

Figure 2:
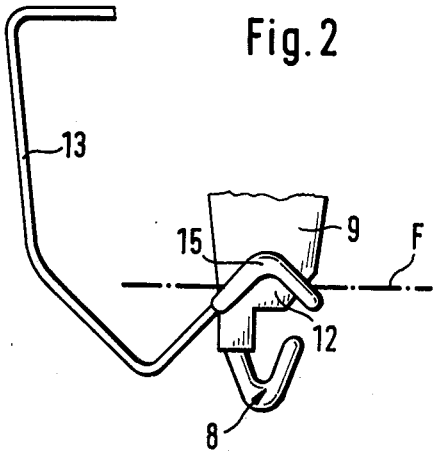
FIG. 2 is an enlarged detailed view along line II—II of FIG. 1.

A swivel arm 13 is supported pivotally by means of a bearing 14 about an axis which extends perpendicularly with respect to the drum axis, which bearing 14 is in the area of the rotatable support bearing between the drum and the carrying device 2. The swivel arm 13 (FIG. 2) has multiple bends: first, starting out from the bearing 14, approximately perpendicular with respect to the drum axis, subsequently at an almost right angle in a direction toward the removal edge 6 of the drum, and approximately so long as it corresponds with the spacing of the removal edge from the bearing 14, subsequently at an obtuse angle downwardly, and subsequently at an approximately right angle again upwardly. This last section of swivel arm 13 is followed by a thread-control element 15 in the form of an angle or V-shape, the first leg of which is in alignment with the last section of the swivel arm and the other freely ending leg of which defines with it an angle of at least 90°, such that the angle opens downwardly. The thread-control element 15 is preferably formed with the swivel arm 13 in one piece of wire and additionally has a coating of ceramic. Details of the thread-guiding member 8 and of the thread-control element 15 can be taken from FIG. 2. In FIGS. 1 and 2, the thread-control element 15 is fixed in a first position on the holding plate 9 in such a manner that it is resiliently snapped onto the shoulder above projection 12, which shoulder conforms to the angular shape of element 15. The thread-guiding member 8 is, as illustrated in FIGS. 1 and 2, in its second position wherein it is below the removal edge 6 of the drum. In this position, the unwinding thread F' runs from the removal edge 6 of the drum downwardly through the thread-guiding member 8. In this position, the thread-control element 15 does not come into contact with the thread F'. The thread F' is then fed through a known tension-sensing shut-off device 16 and thence to the knitting machine.

Figure 3:
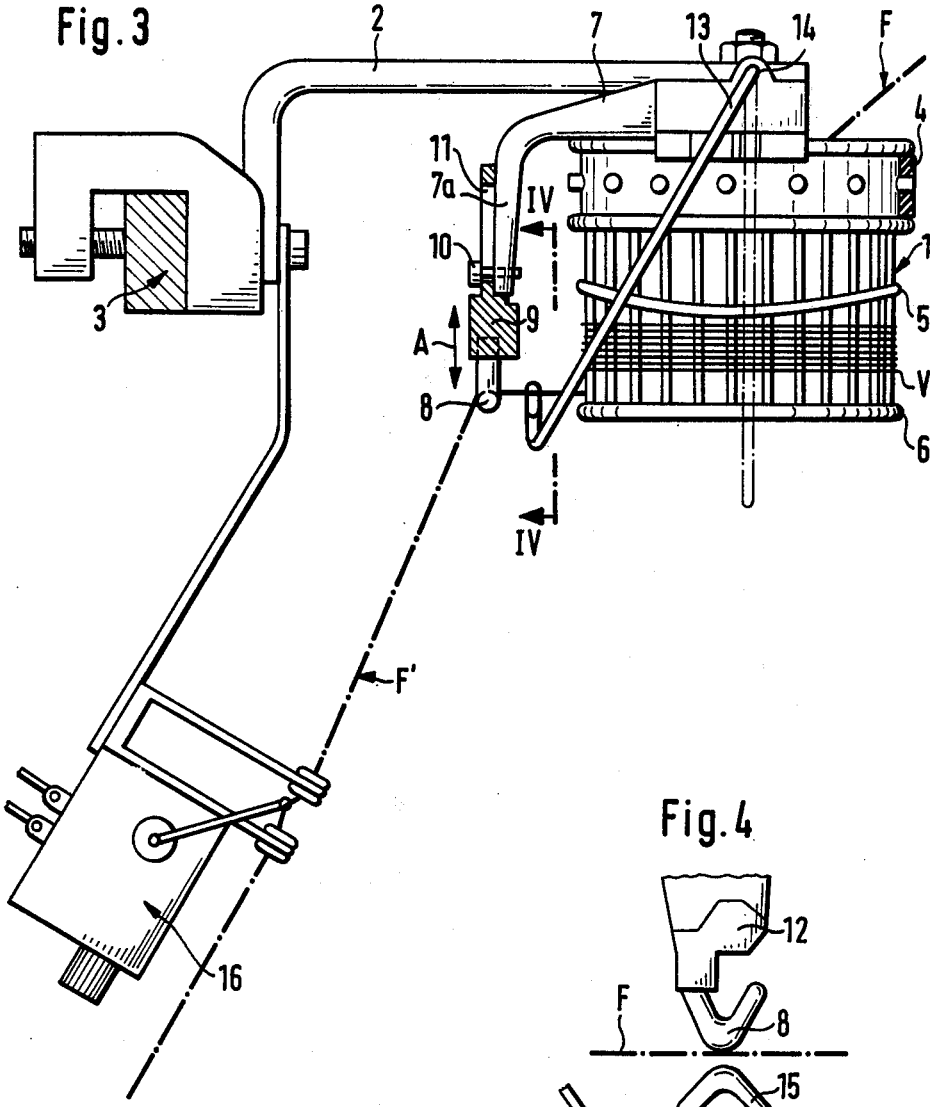
FIG. 3 illustrates the device in a second operating position and in a position for intermittent thread delivery.
Figure 4:
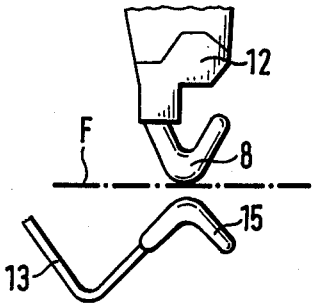
FIG. 4 is an enlarged view along line IV—IV of FIG. 3.

FIG. 3 illustrates the same device as FIG. 1 in two different operating positions. Here only the differences will be discussed. The thread-guiding member 8 is adjusted upwardly and fixed with its holding plate 9 on the leg *7a* of the support arm 7 in such a manner that member 8 is approximately at the level of the drum removal edge 6. The thread-control element 15 is released from its fixed position above the projection 12 and is freely movable with the swivel arm 13. In the illustrated solid-line position shown in FIG. 3, the control element 15 is held by the removal tension of the thread F'. FIG. 4 illustrates this position but, for clarity of illustration, the thread-control element 15 has been displaced vertically downwardly relative to the thread-guiding member 8.

FIG. 3 also illustrates in dash-dot lines a second fixed position of the thread-control element 15. In this position the swivel arm 13 is snapped into a lock recess 17 which is in the area of the bearing 14.

The described thread-delivery device can be utilized for different thread materials. The position of the thread-guiding member 8 and of the thread-control element 15 can be varied depending on this material. The position shown in FIGS. 1 and 2 is for smooth threads, the windings of which do not stick to one another. The lowered thread-guiding member 8 forces the unwinding thread from the removal-edge path directly downwardly. As soon as the thread tension reduces so that the thread becomes loose, as due to breakage, the shut-off means 16 switches off the drum drive. However, even then the drum can still rotate a little further. The removal point of the thread on the removal edge also carries out this additional rotary movement, so that the loose thread is carried along somewhat. Since the withdrawn thread, however, is pulled downwardly by the thread-guiding member 8, this prevents the loose thread from rewinding backwardly onto the drum. The thread-control element 15 is, in this operation, not in contact with the thread F' and does not act on it.

FIGS. 3 and 4 illustrate a position of the thread-guiding member 8 and of the thread-control element 15 which is designed for processing of fleecy woolen threads or equivalent such threads, the windings of which have a strong adhesion to one another. The thread-guiding member 8 is fixed in a position in which it is approximately at the level of the plane of the removal edge 6. This plane is indicated in FIGS. 2 and 4 by a line identified with the letter E. The thread-guiding member 8 thus leads the withdrawn thread F' away from the drum approximately at the level of this plane. This position of member 8 prevents imposition of a downwardly-directed tension component on the withdrawn thread, and prevents further thread windings from being pulled downwardly off of the drum. The swivel arm 13 of the thread-control element 15 is freely movable. The thread-control element 15 rests, through its own weight, on the withdrawn thread section between the drum removal edge and the thread-guiding member 8 and is held up by the tension in the withdrawn thread. As soon as the removal tension lets up, the thread-control element 15 presses, through its weight, the loose thread section between the drum removal edge 6 and the thread-guiding member 8 downwardly and prevents the thread from rewinding on the drum in the wrong direction. As soon as the normal removal tension is again built up in the thread F', the thread-control element 15 along with the thread is again lifted upwardly to the level of removal edge 6.

The snapped-in axial position of the thread-control element 15 and its swivel arm 13, as indicated by dash-dot lines in FIG. 3, is utilized to carry out adjusting operations on the machine and permits a free and intermittent removal of the thread downwardly from the drum.

The invention is not limited to the exemplary embodiments. Thus, it is possible to construct within the scope of the invention the thread-guiding member and/or the thread-control element as open or closed eyelets, although this is not as advantageous. Furthermore it is possible to provide in place of the lock shoulder on the holding plate for the thread-guiding member, a lock point for the swivel arm near the lock point 17.

Figure 5:
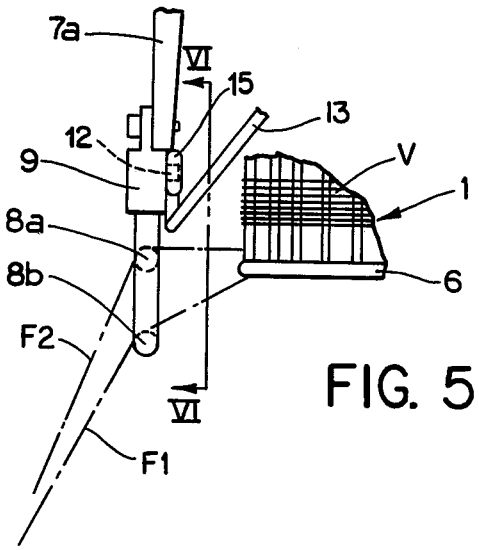
FIG. 5 is a fragmentary view similar to FIG. 1 but illustrating a variation of the invention.
Figure 6:
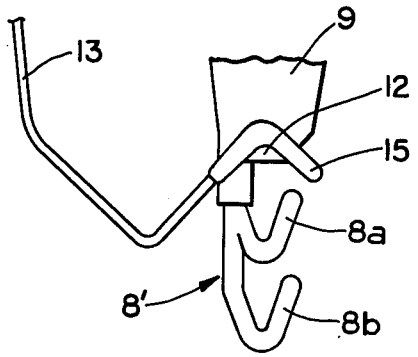
FIG. 6 is a view taken along line VI—VI in FIG. 5.

FIGS. 5 and 6 illustrate a variation of the invention wherein, instead of adjustably moving the thread-guiding member 8 between the upper and lower positions illustrated in FIGS. 1 and 3, there is instead provided a thread-guiding member 8' which is fixedly mounted by bracket 9 on arm 7*a*. This thread guiding member 8' has upper and lower thread-guiding hooks 8*a* and 8*b* which are fixedly connected in vertically spaced relationship. The upper hook 8*a* is positioned substantially at the level of the thread removal edge 6 and thus corresponds to the operating position shown in FIG. 3. The other thread guiding hook 8*b* is positioned downwardly a selected distance below the thread removal rim 6, and thus substantially corresponds to the operating position shown in FIG. 1.

When the device of FIGS. 5 and 6 is used with threads having little adhesion between adjacent thread windings, then the withdrawn thread is hooked over the lower thread-guiding hook 8*b* and withdrawn along the path F1. The thread-control element 15 is held in a fixed position away from the thread path, such as by being engaged on the projection 12. This mode of operation is thus identical to that of FIG. 1 described above.

On the other hand, when the device is utilized with threads which have substantial adhesive characteristics between adjacent thread windings, then the withdrawn thread is passed over the upper thread-guiding hook 8*a* and withdrawn along the path F2. The thread-control element 15 is disposed in engagement with the withdrawn thread in the region between the withdrawal edge 6 and the hook 8*a*. This operation corresponds to that of FIG. 3, as described above.

The embodiments of the invention in which an exclusive property or privilege is claimed are defined as follows:

1. In a thread-delivery device for textile machines, comprising a drum which can be driven for rotation, onto which drum can be tangentially wound a thread coming from a thread bobbin for forming an intermediate thread storage, and from which for positive delivery the thread can be removed tangentially in the area of a removal edge of the drum through a thread-guiding means which is arranged approximately at the level of the removal edge radially outside of the drum, and a thread-control element is provided which is transversely movably supported relative to the withdrawn thread, which thread-control element is maintained by the withdrawn thread in one operating position in the area of the thread path between the drum and the thread-guiding means approximately at the level of the removal edge of the drum when the withdrawn thread is at normal operating tension, and which thread-control element moves when the thread tension is reduced due to its weight or spring loading into a position below the plane of the removal edge, the improvement wherein the thread-guiding means is selectively engageable with the withdrawn thread in a first position at the level of the removal edge and in a second position below the level of the removal edge, and means for holding the thread-control element in a position spaced from the thread path when the withdrawn thread engages the thread-guiding means at said second position.

2. A device according to claim 1, wherein the holding means permits the thread-control element to be fixed in a first location above the thread path.

3. A device according to claim 2, wherein the holding means also includes means for permitting the thread-control element to be fixed in a second location below the plane of the removal edge.

4. A device according to claim 1, wherein the thread-control element is constructed as downwardly open angle hook on a swivel arm.

5. A device according to claim 2, wherein the holding means includes a snap-in projection for the thread-control element, said projection being mounted above the thread-guiding means.

6. A device according to claim 5, wherein the thread-control element is constructed as a downwardly opening angle hook, and wherein the snap-in projection defines an angular snap-in shoulder on a holding plate of the thread-guiding means, which snap-in shoulder corresponds with the angle hook.

7. A device according to claim 4, wherein the legs of the angle hook open at an angle of at least 90°.

8. A device according to claim 4, wherein the angle hook is provided with a ceramic coating.

9. A device according to claim 4, wherein the holding means includes means located in the area of a swivel bearing for the swivel arm for stationarily holding the swivel arm.

10. A device according to claim 1, wherein the thread-guiding means comprises a thread-guiding member constructed as an upwardly open V-shaped hook and arranged with its two legs in a plane approximately transversely to the withdrawn thread.

11. A device according to claim 1, wherein the thread-guiding member is provided with a ceramic coating.

12. A device according to claim 1 or claim 4, wherein the thread-guiding means has a single thread-guiding member which is vertically adjustably movable relative to the drum between the first and second positions.

13. A device according to claim 1 or claim 4, wherein the thread-guiding means is fixedly positioned and has first and second thread-guiding members which are fixedly positioned in the first and second positions, respectively.

14. A device according to claim 13, wherein said thread-guiding members each comprise an upwardly opening V-shaped hook.

15. A device according to claim 12, wherein said thread-guiding member comprises an upwardly opening V-shaped hook.

* * * * *